United States Patent [19]

Allen et al.

[11] Patent Number: 4,979,739

[45] Date of Patent: Dec. 25, 1990

[54] BALL RETURN CONTROL APPARATUS

[75] Inventors: Bruce D. Allen, Saginaw; Richard B. Shelton, Bay City, both of Mich.; Ullrich K. A. Künnecke, Bingen/Rhein, Fed. Rep. of Germany; Robert J. Brejcha, St. Charles; Edward K. Miguel, DeKalb, both of Ill.

[73] Assignee: Kidde Recreation Products, Inc., Bay City, Mich.

[21] Appl. No.: 388,768

[22] Filed: Aug. 1, 1989

Related U.S. Application Data

[63] Continuation of Ser. No. 148,762, Jan. 26, 1988, abandoned.

[51] Int. Cl.[5] ..... A63D 15/00

[52] U.S. Cl. ..... 273/11 C; 273/122 A; 273/125 A

[58] Field of Search ..... 273/10, 11 C, 11 R, 273/14, 125 R, 125 A, 121 A, 121 D, 123 A, 124 A, 122 A, 29 A; 124/50, 49; 221/15, 295, 296, 289, 194

[56] References Cited

U.S. PATENT DOCUMENTS

| | | | |
|---|---|---|---|
| 1,937,551 | 12/1933 | Cook | 273/11 C |
| 2,297,264 | 9/1942 | Veneri | 273/11 C |
| 2,348,267 | 5/1944 | Sikes | 273/11 C |
| 2,574,363 | 11/1951 | Wilhem | 273/11 C |
| 2,765,169 | 10/1956 | Wilhem | 273/11 C |
| 3,308,802 | 3/1967 | Applegate | 124/50 |
| 3,358,995 | 12/1967 | Braun et al. | 273/11 C |
| 3,466,036 | 9/1969 | Connelly et al. | 273/11 C |
| 3,618,943 | 11/1971 | Milu | 273/11 C |
| 4,662,846 | 5/1987 | Quercetti | 273/122 R X |
| 4,726,586 | 2/1988 | Shelton et al. | 273/11 C |

FOREIGN PATENT DOCUMENTS

| | | | |
|---|---|---|---|
| 725558 | 3/1955 | United Kingdom | 273/11 C |
| 1164229 | 9/1969 | United Kingdom | 273/11 C |
| 1494265 | 12/1977 | United Kingdom | 273/11 C |

*Primary Examiner*—Edward M. Coven
*Assistant Examiner*—Sebastiano Passaniti
*Attorney, Agent, or Firm*—Learman & McCulloch

[57] ABSTRACT

A pool table having a playing surface with which ball accomodating pockets are associated. Pocketed balls are conveyed by a runway system via a trap toward a compartment at one end of the table that is accessible to a player. The trap has a gate operable to prevent passage of the object balls into the compartment. The operation of the gate is controlled by a latch which is movable between a first position in which it latches the gate in ball-blocking position and a second position in which it enables balls to pass the gate. The position of the latch is responsive to operation of a latch driving motor.

17 Claims, 3 Drawing Sheets

BALL RETURN CONTROL APPARATUS

This is a continuation of copending application Ser. No. 07/148,762, filed on Jan. 26, 1988, now abandoned.

This invention relates to control apparatus for a pool table having a playing surface and ball-receiving pockets in which balls from the playing surface may be accommodated. The pockets communicate with a ball storage or retrieval compartment to which pocketed balls may be delivered for retrieval under the control of a gate that is movable between two positions in one of which the balls may pass into the compartment and in the other of which movement of the balls into the compartment is blocked.

BACKGROUND OF THE INVENTION

Coin controlled pool tables are in wide usage and each such table conventionally has a playing surface adjacent which are several pockets for the accommodation of a cue ball and a complement of object balls. Each pocket has associated therewith a runway leading to a trough which, in turn, leads to a compartment from which pocketed balls may be retrieved. It is conventional to prevent retrieval of pocketed object balls until such time as one or more coins of predetermined denominations are deposited in a coin controlled actuating mechanism which then is operable to enable access to such balls.

Many of the mechanisms currently in use for limiting access to pocketed object balls and separating the cue and object balls perform their intended functions satisfactorily, but have some disadvantages. For example, most of the control mechanisms currently in use are composed of complex linkage assemblies which are expensive to manufacture and assemble and require frequent maintenance. Because of the complexity of such mechanisms proper maintenance requires skilled personnel and usually takes considerable time. In many instances, maintenance or repair of the control mechanism necessitates removal of the pool table from service for an inordinate period of time.

A relatively simple ball control mechanism is disclosed in U.S. patent application Ser. No. 699,355, filed Feb. 7, 1985 now Pat. No. 4,726,586 issued Feb. 23, 1988. Such mechanism utilizes a movable, magnetically permeable gate which normally occupies a ball-blocking position in the path of balls enroute to the ball storage compartment but which is movable to an inactive position in response to the actuation of a coin operated actuating assembly. Once the gate has been moved to its inactive position it remains in such position until all balls have passed the gate whereupon the latter returns automatically to its ball-blocking position. Although this mechanism performs its intended function quite well, it does not have the capability of permitting more than one game to be played without depositing one or more additional coins.

For some purposes the necessity of actuating the ball control mechanism following the completion of each game is satisfactory. In other instances, however, it is preferred to enable players access to the ball storage compartment, whenever desired, within a given period of time. In those instances the ball-blocking mechanism must be disabled for the given time period.

An object of the invention is to provide ball control apparatus that is operable selectively to prevent the playing of more than one game per operation of the coin actuating mechanism, or to permit access to all balls for a limited period of time, or to permit the playing of a selected number of games.

SUMMARY OF THE INVENTION

Apparatus constructed in accordance with the invention is adapted for use in conjunction with a pool table having a playing surface adjacent which ball-accommodating pockets are associated. Each pocket communicates with a downwardly inclined runway which, in turn, communicates with a trap by means of which all pocketed balls are delivered by gravity to a pathway leading to a ball storage compartment. Interposed between the trap and the storage compartment is a barrier or gate which is movable between positions in one of which it blocks passage of pocketed balls to the compartment and in the other of which it permits passage of such balls to the compartment. Movement of the gate to its ball-blocking position is effected by a movable latch which, in response to movement through a selected distance to a latching position, bears against and latches the gate in its ball-blocking position. Movement of the latch from its latching position to an inactive position effects disengagement of the latch and the gate, thereby enabling movement of the balls past the gate to the storage compartment. Movement of the latch is effected by an electric motor, a solenoid, or other suitable driving device.

The force under which the gate normally is held latched in its closed position is such as to maintain the gate closed regardless of the number of balls which may occupy the trap. However, once the latch has been moved to its inactive position, even a single ball in the trap is capable of exerting on the gate a force sufficient to effect opening thereof, thereby enabling each ball in the trap to pass the gate.

The time that the latch remains in its inactive position depends upon the latch operating mechanism that is actuated. In one embodiment of the invention the gate will be re-latched in its ball-blocking position shortly after the last ball in the trap passes the gate. In another embodiment the latch is maintained in its inactive position for a selected period of time, thereby enabling pocketed balls to be retrieved from the storage compartment throughout such time period.

The latch comprises a rotary cam having a radially projecting rise or lobe operable in one position of the cam to engage and hold the gate in its ball-blocking position. Such cam also has radially recessed surfaces which may be spaced sufficiently far from the gate as to enable the gate to pass balls freely.

The apparatus preferably is wholly contained within a drawer-like housing which may be slid as a unit into and out of a space formed at one end of the table. Thus, the entire assembly may be removed from the table as a unit for maintnance and servicing when required. If maintenance or servicing of the assembly will require more than a few minutes, the unit requiring attention may be replaced by a different unit, thereby avoiding prolonged disuse of the affected table.

THE DRAWINGS

The presently preferred embodiments of the invention are disclosed in the following description and illustrated in the accompanying drawings, wherein.

DETAILED DESCRIPTION

Figure 1:
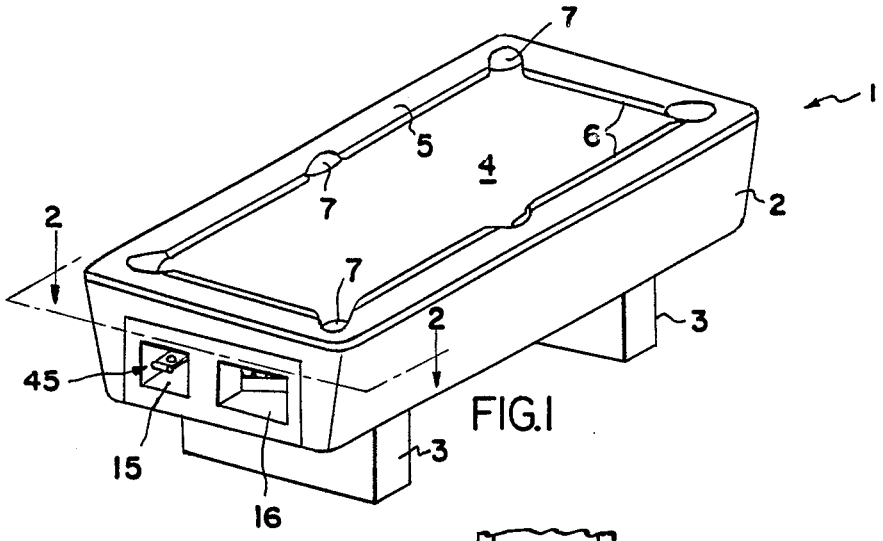
FIG. 1 is an isometric view of a pool table of the kind with which apparatus constructed in accordance with the invention is adapted for use.

Apparatus constructed in accordance with the preferred embodiments of the invention is adapted for use with a pool table 1 comprising a frame 2 supported on legs 3 and having a horizontal, rectangular playing surface 4 bounded by rails 5 on which cushions 6 are supported, as is conventional. At each of the four corners of the playing surface is an opening or pocket 7 and a similar pocket 7 is associated with each of the two opposed, longer side rails 5. A complement of fifteen object balls O and one cue ball C are used in conjunction with the table, and each of such balls preferably is of uniform diameter and capable of being pocketed in any of the openings 7.

Each of the openings 7 has associated therewith a downwardly inclined runway 8 which extends from adjacent the associated opening inwardly toward the center of the table and communicates with a common trough 9 which is downwardly inclined toward one end of the table.

At that end of the table toward which the trough 9 slopes is a space within which is a drawer 10 slideably is accommodated. The drawer comprises a bottom 11 having upstanding, spaced apart side walls 12, a rear wall 13, and a front wall 14. Two side-by-side openings are formed in the front wall 14. One opening leads to a recess 15 adjacent one side wall 12 and the other leads to a ball storage compartment 16 accessible via its opening. The recess and the compartment are separated by a partition 17. The purposes of the recess 15 and the compartment 16 will be explained hereinafter. The rear wall 13 is provided with an opening 18 through which the terminal end of the trough 9 may extend.

Figure 4:
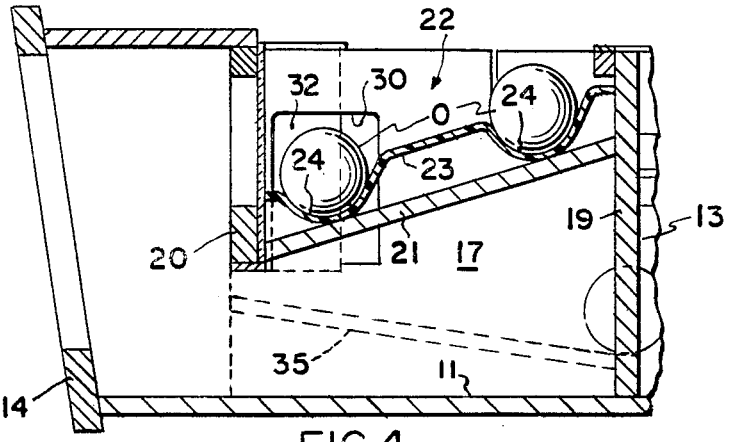
FIG. 4 is a sectional view taken on the line 4—4 of FIG. 3.

Between the rear and front walls 13, 14 of the drawer 10 and parallel thereto is a pair of vertical partitions 19 and 20 which are spanned by a support 21 that is inclined downwardly toward the front wall 14. See FIG. 4. Mounted on the support 21 is a trap 22 comprising a preferably molded, unitary body 23 having an upwardly open groove or pathway 24 formed therein. The pathway has two segments 25 and 26. The pathway segment 25 is inclined downwardly to the right, and the pathway segment 26 is inclined downwardly to the left. These inclinations, coupled with the forward pitch of the support 21, enable the pathway to be sufficiently inclined to ensure downward movement by gravity of the object balls along the pathway.

Interposed between the ball delivery trough 9 and the upper or inlet end of the trap pathway 24 is transfer means designated generally by the reference character 28 for diverting the cue ball C from the pathway 24 to another pathway and directing the object balls O to the pathway 24. The transfer device is exactly like that disclosed in the aforementioned patent application.

Object balls O introduced to the upper end of the pathway 24 roll downwardly along the latter toward an opening 30 formed in the partition 17. See FIGS. 2 and 4. Fixed to the partition 17 and overlying the opening 30 is a mounting block 31. A gate 32 formed of any suitable material lies athwart the path of movement of the balls at the opening 30. The gate is pivoted at its upper end to the mounting block 31 by means of a hinge 33 for swinging movements about a horizontal axis.

Spaced from, but parallel to, the partition 17 is a second partition 34. Spanning the partitions 17 and 34 is a downwardly inclined ramp 35 which, together with the partitions, forms a channel 36 for the accommodation of balls which pass through the opening 30. The channel 36 is closed at one end by a wall 37.

Figure 5:
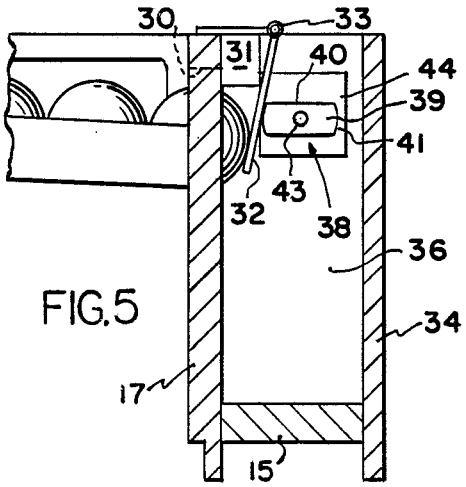
FIG. 5 is a sectional view, on an enlarged scale, taken on the line 5—5 of FIG. 2.

Latch means designated generally by the reference character 38 is provided for controlling the position of the gate 32. In the embodiment shown in FIGS. 2–6 the latch means comprises a rotary cam 39 having two parallel flat sides 40 at opposite ends of which are rises or lobes 41. The cam is fixed to the armature shaft 43 of an electric motor 44 that is mounted on the wall 37. The arrangement is such that, when a lobe 41 bears against the gate 32 as is shown in FIG. 5, the gate is latched in a position in which it blocks the passage of balls through the opening 30. When the cam is rotated to a position in which one of the flat sides 40 confronts the gate, there is sufficient space between the cam and the gate to enable a ball on the trap to swing the gate to an open position, pass the gate, and enter the channel 36 via the opening 30.

Coin actuating means 45 (FIGS. 1 and 2) is provided to control the operation of the latch means 38 and comprises a reciprocable slide 46 forming part of a coin controlled mechanism 47 of known construction and mounted on a shelf 48 spanning the partition 34 and the adjacent side wall 12. The slide is accessible via the recess 15. A spring 49 constantly biases the slide 46 to the position shown in FIG. 2. A normally open switch 50 lies in the path of movement in one direction of the slide 46 so as to be closed thereby, and is connected to a suitable source of electrical energy such as a battery 42 mounted on the shelf 48. Although not shown in the drawings for purposes of clarity, the switch 50 also has terminals connected to the terminals of the motor 44 so as to energize the latter upon closing of the switch 50.

Disregarding for the moment the gate 32 and its controlling mechanism, a game can be commenced by placing the object balls O and the cue ball C on the playing surface 4 of the table 1. The cue ball is used by one or more players to pocket the object balls.

As each object ball O is pocketed it moves down the associated runway 8 to the trough 9 and enters the drawer unit 10 via the opening 18 in the rear wall 13. The object ball rolls by gravity off the trough 9 onto the transfer device 28 and is guided into the inlet end of the trap segment 25 of the pathway 24 in the manner disclosed in the aforementioned patent. Such object ball will roll downwardly along the pathway 24 until it engages the gate 32 which lies athwart the pathway at the partition 17. If the latch cam 39 then is in its gate latching or active position, one of the lobes 41 of the cam will bear against the gate, thereby enabling the latter to block passage of the ball through the opening 30. Object balls O which subsequently are pocketed will follow the same route and come to rest against the first and any additional pocketed object balls as is indicated in FIGS. 2 and 3.

Figure 2:
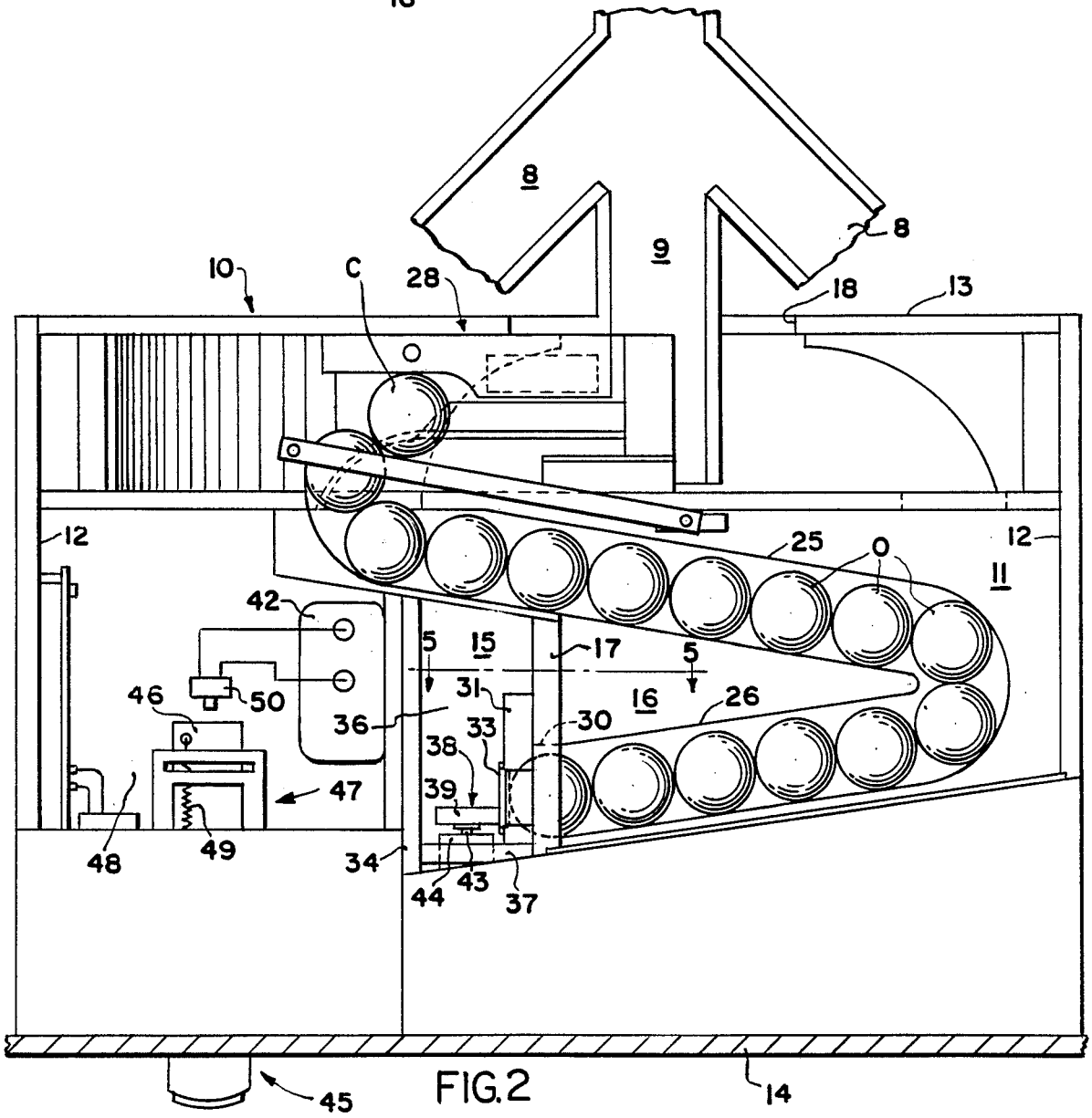
FIG. 2 is a fragmentary, sectional view on a greatly enlarged scale and taken on the line 2—2 of FIG. 1.
Figure 3:
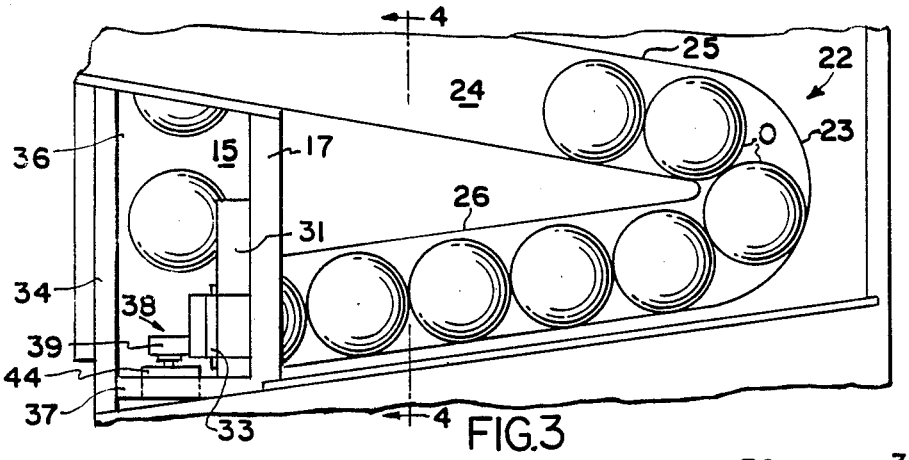
FIG. 3 is a view similar to FIG. 2, but illustrating some of the parts in adjusted positions.
Figure 6:
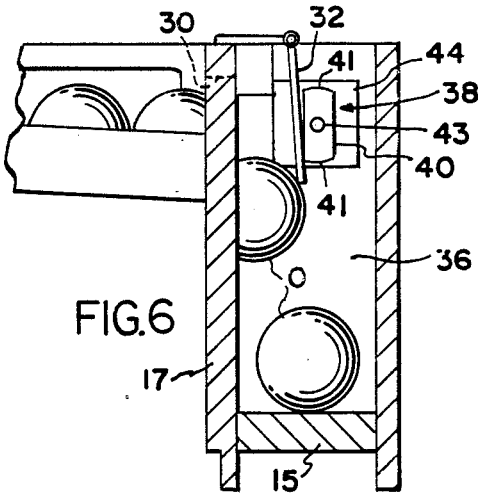
FIG. 6 is a sectional view like FIG. 5, but illustrating some of the parts in adjusted positions.

When the game has been completed and all of the object balls are in the trap 22, one or more coins must be inserted in the slide 46 of the coin controlled mechanism 47 so as to enable the slide to be slid from the position shown in FIG. 2 toward and into engagement with the switch 50, thereby energizing the motor 44 and driving the latch cam 39 through 90° to an inactive position in which the mass of the object ball or balls in the trap swing the gate 32 from its closed position to its open position as is best shown in FIG. 6. Following movement of the cam to its gate releasing or inactive position it remains in that position for a sufficient period of time to permit all of the object balls O on the pathway 24 to roll downwardly and pass in succession through the opening 30 in the partition 17 into the compartment 16. Thereafter, the slide may be released whereupon the motor rotates the cam 39 to an active position in which one of the lobes 41 bears against the gate and holds the latter in its ball-blocking position.

Balls passing the gate 32 enter the channel 36 and are delivered by gravity to the storage compartment 16 in the manner described in the aforementioned patent.

In the event the cue ball C is pocketed prior to the end of the game, the transfer device 28 will divert the cue ball from the path taken by the object balls O in the manner described in the aforementioned patent.

The drawer unit 10 is a fully integrated assembly and is interchangeable with any other like unit, thereby enabling a unit requiring repair or maintenance to be replaced by another unit with substantially no loss of playing time. It will be understood that suitable drawer locking means (not shown) will be included as part of the apparatus so as to preclude unauthorized tampering therewith.

In the operation of coin actuated pool games there are two basic kinds of control routines: rack play and time play. In rack play, each pocketed object ball is retained in the trap until the gate latch is actuated in such manner as to enable one complement, or rack, of balls to pass from the trap to the storage compartment. Depending upon the construction of the control mechanism, a player may preselect one or a plurality of racks to be played. In time play the gate latch is maintained in its inactive position for a predetermined period of time, thereby enabling any pocketed ball to reach the storage compartment during such time period. Following the passage of such time period the gate is latched in its blocking position from which it cannot be moved until a player deposits additional coins and selects either rack play or time play.

Figure 7:
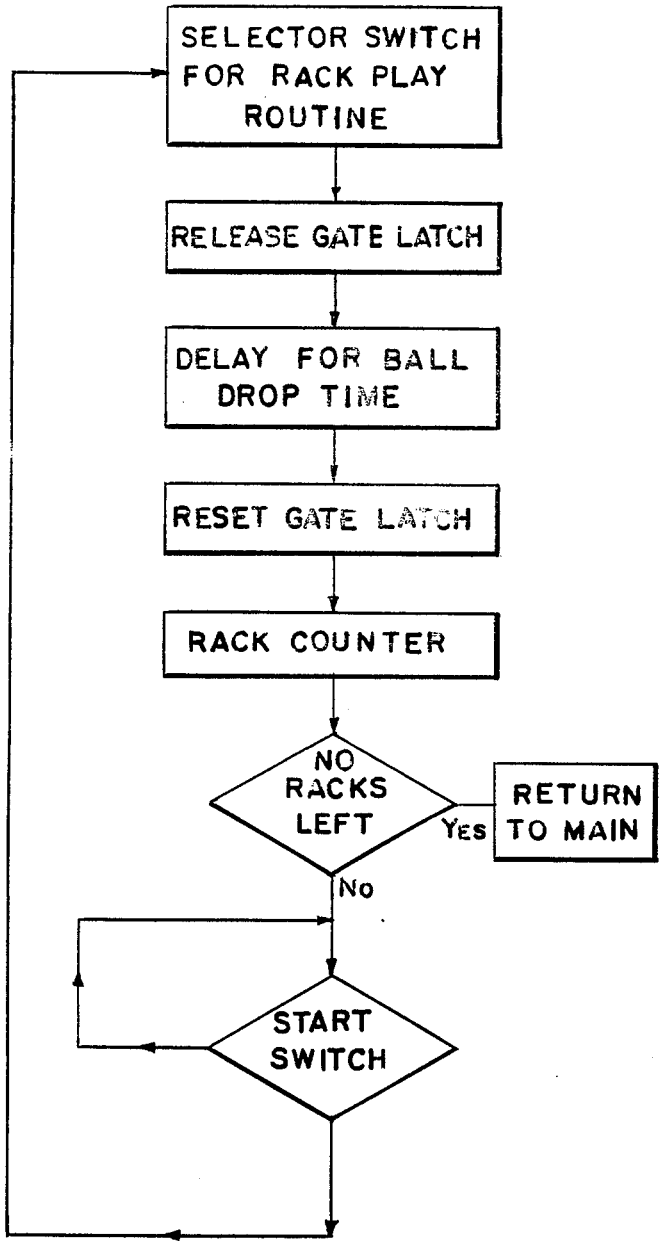
FIG. 7 is a flow diagram of one routine for which the apparatus may be programmed.
Figure 8:
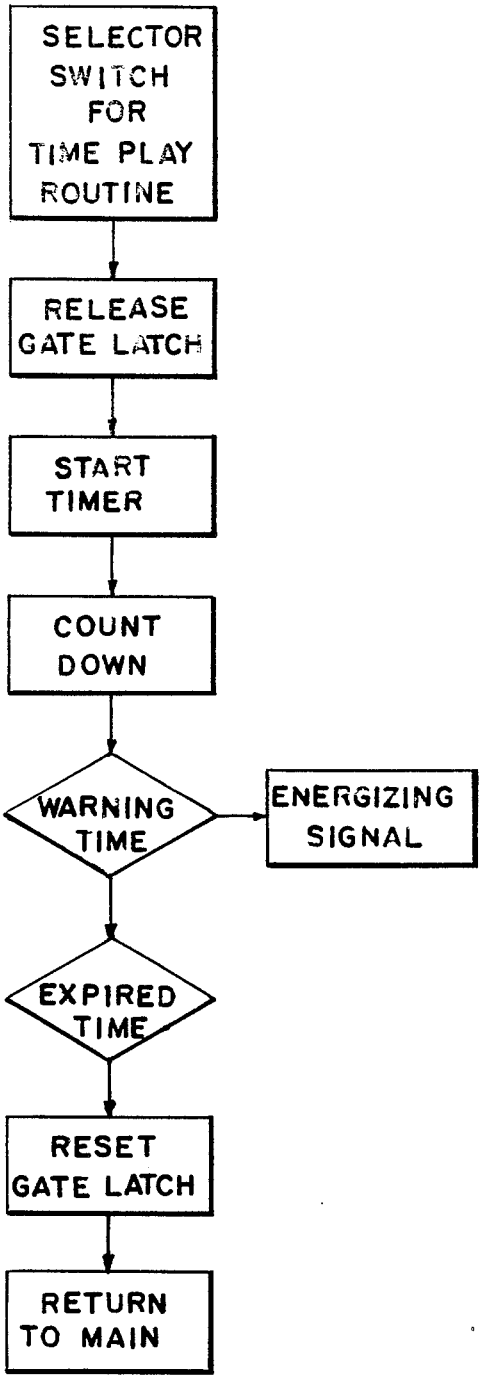
FIG. 8 is a flow diagram of a second routine.

In apparatus constructed according to a preferred embodiment of the invention a player has the option of selecting either rack play or time play. The rack play routine is illustrated in flow chart form in FIG. 7, whereas the time play routine is illustrated in flow chart form in FIG. 8.

In the rack play routine, the player selects such routine by actuating a selector switch (not shown) following which the switch 50 is energized and its shaft 43 driven in a direction to rotate the cam 39 to its gate release position. If desired, a delay timer of known kind interrupts rotation of the latch for a period of time sufficient to enable all balls in the trap to pass the gate 32, whereupon rotation of the latch recommences and continues for a period of time sufficient to reset the latch and hold the gate in its ball blocking position. This operation subtracts one rack from the preset rack counter. If more than one rack has been preset in the rack counter, it is possible to release the gate latch by operation of a start switch, thereby permitting as many successive racks of balls to be released as have been preset in the rack counter. When the last of the preset racks has been released, the start switch is disabled and the gate control cam is reset for operation only in response to the deposit of additional coins.

When the time play option is selected, by closing of a suitable switch, the payment of a predetermined sum of money will energize the gate release latch driving motor 44 and drive the latch to its inactive position, thereby enabling balls in the trap to pass the gate and be received in the ball storage compartment. At the same time, a timer will be energized to interrupt operation of the motor and thereby maintain the latch cam in its inactive position. Following the elapse of a predetermined portion of the selected time period, a signal may be energized to warn the players of the approaching end of the time period. At the expiration of the time period the latch driving motor again will be energized to drive the latch cam to its active position and hold the gate in its ball blocking position. The system then will be in condition to be reactivated in either the rack play or the time play routine.

Many different variations of the two routines may be devised as will be understood by those skilled in the electric motor drive programming art.

Figure 9:
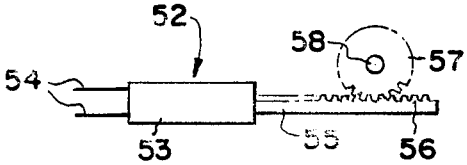
FIG. 9 is a side elevational view of a modified latch driving apparatus.

It is not essential that the latch cam drive means constitute an electric motor. As shown in FIG. 9, it is possible to use other drivers, such as a solenoid 52 having a winding 53 connected to a suitable source of energy by wiring 54. The solenoid includes an extensible and retractable armature 55 having a toothed rack 56 in mesh with a pinion 57 fixed to one end of a shaft 58 journalled in the wall 37 and having its other end fixed to the latch cam 39. Extension and retraction of the armature 54 will effect rocking of the cam between its latching and inactive positions in a manner like that referred to earlier.

The disclosed embodiments are representative of presently preferred forms of the invention, but are intended to be illustrative rather than definitive thereof. The invention is defined in the claims.

We claim:

1. Pool ball control apparatus for selectively disabling and enabling delivery of one or more of said balls to a ball retrieval compartment, said apparatus comprising means forming a compartment of such capacity as to accommodate a plurality of said balls at the same time; means forming a ball-supporting pathway leading to said compartment; a gate; means mounting said gate upstream of said compartment for engagement by each ball traversing said pathway and for movements between first and second positions in the first of which none of said balls can pass said gate and in the second of which all of the balls on said pathway successively may pass said gate and move along said pathway to said compartment; movable latch means operable in one position to exert a latching force on said gate and releasably retain the latter in said first position; and operating means coupled to said latch means for moving the latter from said one position to another position in which said gate is movable to its second position.

2. Apparatus according to claim 1 wherein said gate is mounted for rocking movements between said first and second positions.

3. Apparatus according to claim 1 wherein said pathway has an inclination such that the mass of a single ball on said pathway is sufficient to effect movement of said gate to its second position when said latch means is in said another position.

4. Apparatus according to claim 1 wherein said latch means when in said one position engages said gate.

5. Apparatus according to claim 1 wherein said latch means when in said another position is disengaged from said gate.

6. Apparatus according to claim 1 wherein movement of said latch means from said another position to said one position effects engagement of said latch means with said gate and movement of the latter to said first position.

7. Apparatus according to claim 1 wherein said latch means comprises a cam.

8. Apparatus according to claim 7 wherein said cam is rockable about an axis.

9. Apparatus according to claim 8 wherein said operating means comprises a motor having a rotary shaft connected to said cam.

10. Apparatus according to claim 1 including means for disabling return movement of said latch means from said another position to said first position for a period of time at least sufficient to enable all balls on said pathway to pass said gate.

11. Apparatus according to claim 1 including time delay means for disabling return of said latch means from said another position to said first position for a selected period of time more than sufficient to enable all balls on said pathway to pass said gate.

12. Apparatus according to claim 1 wherein said operating means comprises a solenoid having a reciprocable rack in mesh with a rotary pinion fixed to said latch means.

13. Apparatus for selectively enabling and disabling delivery of a complement of pool balls to a pool ball retrieval compartment, said apparatus comprising means forming a compartment of such capacity as to accommodate a plurality of said balls at the same time; means forming a pathway leading to said compartment; a gate athwart said pathway upstream from said compartment and past which gate balls that are to be admitted to said compartment must move; means mounting said gate for engagement by each ball traversing said pathway and for movements between a first position in which said gate obstructs said pathway and disables said balls from entering said compartment and a second position in which all of the balls on said pathway successively may pass said gate and enter said compartment; movable latch means; means mounting said latch means for movement from a first position in which said latch means latches said gate in said first position to another position in which said gate is enabled to move to said second position; and drive means coupled to said latch means for moving the latter from its first position to said another position, and return.

14. Apparatus according to claim 13 wherein said latch means comprises a rotary cam.

15. Apparatus according to claim 14 wherein said drive means comprises a rotary motor.

16. Apparatus according to claim 14 wherein said drive means comprises a reciprocable solenoid and a rotary pinion.

17. Apparatus according to claim 13 wherein said drive means is operable to maintain said latch means in either of said positions for a selected period of time.

* * * * *